US011414285B2

(12) United States Patent
Takahashi et al.

(10) Patent No.: US 11,414,285 B2
(45) Date of Patent: Aug. 16, 2022

(54) TRANSPORT DEVICE AND RECORDING DEVICE

(71) Applicant: SEIKO EPSON CORPORATION, Tokyo (JP)

(72) Inventors: Haruna Takahashi, Minamiminowa-mura (JP); Atsuhiko Takeuchi, Matsumoto (JP); Yosuke Nakano, Matsumoto (JP); Shun Ito, Shiojiri (JP); Keiichi Yato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 16/795,214

(22) Filed: Feb. 19, 2020

(65) Prior Publication Data

US 2020/0270085 A1 Aug. 27, 2020

(30) Foreign Application Priority Data

Feb. 21, 2019 (JP) ..... JP2019-029174

(51) Int. Cl.

| | |
|---|---|
| ***B65H 16/02*** | (2006.01) |
| ***B41J 15/04*** | (2006.01) |
| ***B65H 20/02*** | (2006.01) |
| ***B65H 18/02*** | (2006.01) |
| *B65H 16/08* | (2006.01) |
| *B65H 16/10* | (2006.01) |
| *B65H 16/06* | (2006.01) |

(52) U.S. Cl.

CPC ..... *B65H 16/02* (2013.01); *B41J 15/046* (2013.01); *B65H 18/028* (2013.01); *B65H 20/02* (2013.01); *B65H 16/06* (2013.01); *B65H 16/08* (2013.01); *B65H 16/103* (2013.01); *B65H 2403/41* (2013.01); *B65H 2403/942* (2013.01); *B65H 2801/12* (2013.01)

(58) Field of Classification Search

CPC .. B65H 16/02; B65H 20/02; B65H 2403/942; B65H 2801/12; B65H 16/08; B65H 16/103; B65H 18/028; B65H 16/06; B65H 2403/41; B41J 15/046

See application file for complete search history.

(56) References Cited

U.S. PATENT DOCUMENTS 6,414,704 B1 * 7/2002 Yamashita ..... B41J 29/02 347/222
2011/0206439 A1 * 8/2011 Takahashi ..... B65H 19/126 242/598.3

FOREIGN PATENT DOCUMENTS

JP H0577387 A * 3/1993 ..... B41F 3/46
JP 2011-173331 9/2011

* cited by examiner

*Primary Examiner* — Yaovi M Ameh
(74) *Attorney, Agent, or Firm* — Workman Nydegger

(57) ABSTRACT

A transport device unwinds a medium from a roll body to which a shaft member is mounted and transports the medium. The transport device includes an accommodation portion configured to accommodate the roll body, a main body portion to which the accommodation portion is mounted, and a roller pair configured to nip the medium. The accommodation portion and the main body portion are relatively movable. The main body portion includes a rack configured to engage with a gear of the shaft member. The rack is engaged with the gear when the accommodation portion moves relative to the main body portion to be pulled out of the main body portion.

5 Claims, 12 Drawing Sheets

TRANSPORT DEVICE AND RECORDING DEVICE

The present application is based on, and claims priority from JP Application Serial Number 2019-029174, filed Feb. 21, 2019, the disclosure of which is hereby incorporated by reference herein in its entirety.

BACKGROUND

1. Technical Field

The present disclosure relates to a transport device and a recording device.

2. Related Art

As one example of a transport device, JP-A-2011-173331 describes a feeding device including an accommodation portion that supports a shaft member of a roll body around which a medium is wound, a drawer member that is drawable from the accommodation portion, and a roller pair that unwinds the medium from the roll body. In this feeding device, when the drawer member is pulled out of the accommodation portion, the roll body is pulled out together with the drawer member from the accommodation portion. Thus, by drawing out the drawer member from the accommodation portion, a remaining amount of the roll body can be confirmed, or the roll body can be replaced.

In the feeding device described in JP-A-2011-173331, when the drawer member is pulled out in a state in which the medium is nipped between the roller pair, tension is applied to the medium at the time of drawing out the shift member of the roll body from the accommodation portion. In this case, there may be a risk in that the medium is damaged.

SUMMARY

In order to solve the above-mentioned problem, a transport device unwinds a medium from a roll body to which a shaft member is mounted and transports the medium. The transport device includes an accommodation portion configured to accommodate the roll body, a main body portion to which the accommodation portion is mounted, and a roller pair configured to nip the medium. The accommodation portion and the main body portion are relatively movable. The main body portion includes a rack configured to engage with a gear of the shaft member. The rack is engaged with the gear when the accommodation portion moves relative to the main body portion to be pulled out of the main body portion.

In order to solve the above-mentioned problem, a recording device includes the transport device and a recording unit configured to perform recording onto the medium.

DESCRIPTION OF EXEMPLARY EMBODIMENTS

One exemplary embodiment of a recording device including a transport device will be described below with reference to the drawings. The recording device is, for example, an ink jet-type printer that records an image such as characters and photographs on a medium such as a sheet by ejecting ink, which is an example of liquid.

Figure 1:
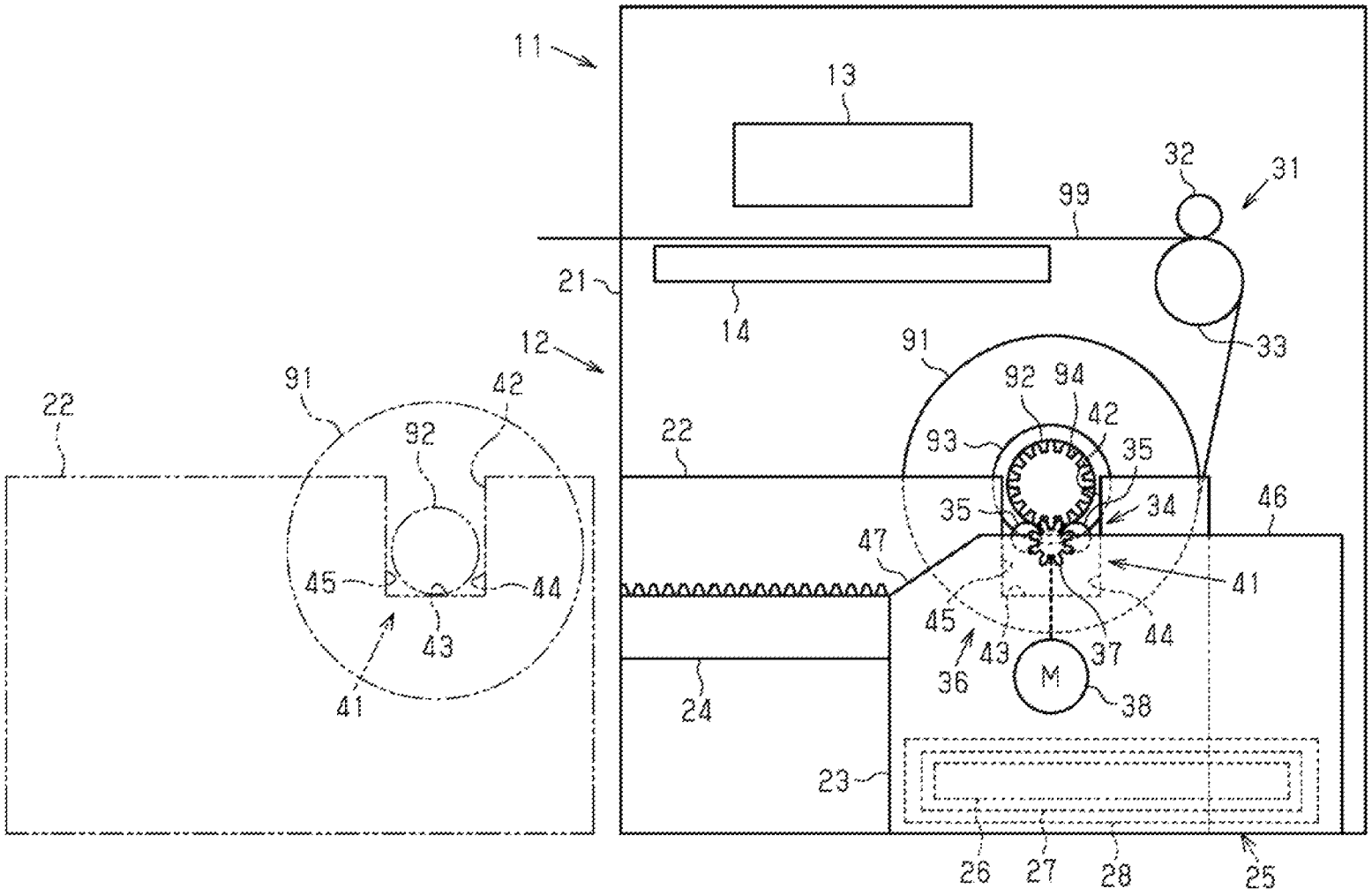
FIG. 1 is a side view schematically illustrating one exemplary embodiment of a recording device including a transport device.

As illustrated in FIG. 1, a recording device 11 includes a transport device 12 that transports the medium 99 and a recording unit 13 that performs recording onto the medium 99. The transport device 12 transports the medium 99 by unwinding the medium 99 from a roll body 91 around which the medium 99 is wounded. The recording unit 13 performs recording onto the medium 99 transported by the transport device 12.

The recording device 11 according to the present exemplary embodiment includes a support portion 14 that supports the medium 99 transported by the transport device 12. The support portion 14 is positioned at a position facing the recording unit 13. The recording unit 13 ejects liquid onto the medium 99 at least in a region supported by the support portion 14.

The transport device 12 transports the medium 99 by unwinding the medium 99 from the roll body 91 to which a shaft member 92 is mounted. The shaft member 92 functions as a shaft of the roll body 91. The shaft member 92 is mounted to the roll body 91 by being inserted into the roll body 91.

In the present exemplary embodiment, the roll body 91 is fixed to the shaft member 92 by mounting holders 93 to both ends of the roll body 91 in a state in which the shaft member 92 is inserted. With this, the roll body 91 is rotatable at the same rotational speed as the shaft member 92. The roll body 91 unwinds the medium 99 by rotating together with the shaft member 92. The roll body 91 is set to the transport device 12 in a state in which the shaft member 92 is mounted.

The transport device 12 includes a housing 21. In the present exemplary embodiment, the housing 21 houses the recording unit 13 and the support portion 14.

The transport device 12 includes an accommodation portion 22 that accommodates the roll body 91, and a main body portion 23 to which the accommodation portion 22 is mounted. The accommodation portion 22 and the main body portion 23 are relatively movable.

For example, the accommodation portion 22 is drawable from the main body portion 23. When the accommodation portion 22 is pulled out of the main body portion 23, the roll body 91 is pulled out together with the accommodation portion 22 from the main body portion 23. Specifically, when the accommodation portion 22 is pulled out of the main body portion 23, the shaft member 92 moves together with the accommodation portion 22 with respect to the main body portion 23. The accommodation portion 22 is pulled out of the main body portion 23 in a state of accommodating the roll body 91. Thus, by drawing out the accommodation portion 22 from the main body portion 23, a remaining amount of the roll body 91 can be confirmed, or the roll body 91 can be replaced.

The accommodation portion 22 indicated with the solid lines and the broken lines in FIG. 1 is in a state of being mounted to the main body portion 23. The accommodation portion 22 indicated with the two-dot chain lines in FIG. 1 is in a state of being pulled out of the main body portion 23. By moving relative to the main body portion 23, the accommodation portion 22 is displaced between the state of being mounted to the main body portion 23 and the state of being pulled out of the main body portion 23. By mounting the accommodation portion 22 that accommodates the roll body 91 to the main body portion 23, the roll body 91 is set to the transport device 12.

The main body portion 23 in the present exemplary embodiment is positioned in the housing 21. In the present exemplary embodiment, the accommodation portion 22 mounted to the main body portion 23 is accommodated in the main body portion 23. Thus, in the present exemplary embodiment, the state in which the accommodation portion 22 is accommodated in the main body portion 23 corresponds to the state in which the accommodation portion 22 is mounted to the main body portion 23. Specifically, the roll body 91 accommodated in the accommodation portion 22 is accommodated in the main body portion 23 in the state in which the accommodation portion 22 is accommodated in the main body portion 23. The transport device 12 may be configured so that the accommodation portion 22 accommodates the main body portion 23. In this case, the state in which the accommodation portion 22 accommodates the main body portion 23 corresponds to the state in which the accommodation portion 22 is mounted to the main body portion 23.

The main body portion 23 includes a rack 24 configured to engage with a gear 94 of the shaft member 92. The gear 94 is provided to, for example, one end in a shaft direction being a direction in which the shaft member 92 extends. The rack 24 is engaged with the gear 94 when the accommodation portion 22 is pulled out of the main body portion 23 by moving relative to the main body portion 23. The rack 24 in the present exemplary embodiment is also engaged with the gear 94 when the accommodation portion 22 is mounted to the main body portion 23 by moving relative to the main body portion 23. The rack 24 is engaged with the gear 94 in a state in which the accommodation portion 22 accommodates the roll body 91 in a process during which the accommodation portion 22 moves relative to the main body portion 23. Thus, along with the accommodation portion 22 moving relative to the main body portion 23, the shaft member 92 rotates.

When the shaft member 92 rotates, the roll body 91 rotates. When the accommodation portion 22 is pulled out of the main body portion 23, the roll body 91 rotates in a direction of unwinding the medium 99. Specifically, when the accommodation portion 22 is pulled out of the main body portion 23, the roll body 91 rotates in a counterclockwise direction in FIG. 1. When the accommodation portion 22 is mounted to the main body portion 23, the roll body 91 rotates in a direction of winding the medium 99. Specifically, when the accommodation portion 22 is mounted to the main body portion 23, the roll body 91 rotates in a clockwise direction in FIG. 1.

The transport device 12 may include a guide rail 25 that couples the accommodation portion 22 and the main body portion 23 with each other. The guide rail 25 guides the accommodation portion 22 and the main body portion 23 to move relatively. The guide rail 25 in the present exemplary embodiment includes the first guide rails 26, the second guide rails 27, and the third guide rails 28.

The first guide rails 26 are mounted to the accommodation portion 22. The third guide rails 28 are mounted to the main body portion 23. The second guide rails 27 are mounted to the first guide rails 26 and the third guide rails 28. The second guide rails 27 are movable with respect to the first guide rails 26 and the third guide rails 28. The first guide rails 26, the second guide rails 27, and the third guide rails 28 are arranged so that the longitudinal directions thereof match with one another.

One end of the second guide rail 27 is mounted to the first guide rail 26. The one end of the second guide rails 27 is movable along the first guide rail 26. The other end of the second guide rail 27 is mounted to the third guide rail 28. The other end of the second guide rail 27 is movable along the third guide rail 28.

In the state in which the accommodation portion 22 is pulled out of the main body portion 23, the guide rail 25 is in an extended state. In the state in which the accommodation portion 22 is mounted to the main body portion 23, the guide rail 25 is in a contracted state. Specifically, in the state in which the accommodation portion 22 is mounted to the main body portion 23, the guide rail 25 is in a state in which the first guide rails 26 are accommodated in the second guide rails 27 and a state in which the second guide rails 27 are accommodated in the third guide rails 28. As described above, the accommodation portion 22 and the main body portion 23 are movable relatively in a state of being coupled with each other with the guide rail 25.

The transport device 12 includes a roller pair 31 that nips the medium 99. The roller pair 31 in the present exemplary embodiment is positioned in the housing 21. For example, the roller pair 31 includes a first roller 32 and a second roller 33. When the first roller 32 and the second roller 33 rotate in a state in which the first roller 32 and the second roller 33 nip the medium 99, the medium 99 is transported. With this, the medium 99 is unwound from the roll body 91. The roller pair 31 in the present exemplary embodiment transports the medium 99 toward the recording unit 13.

Figure 2:
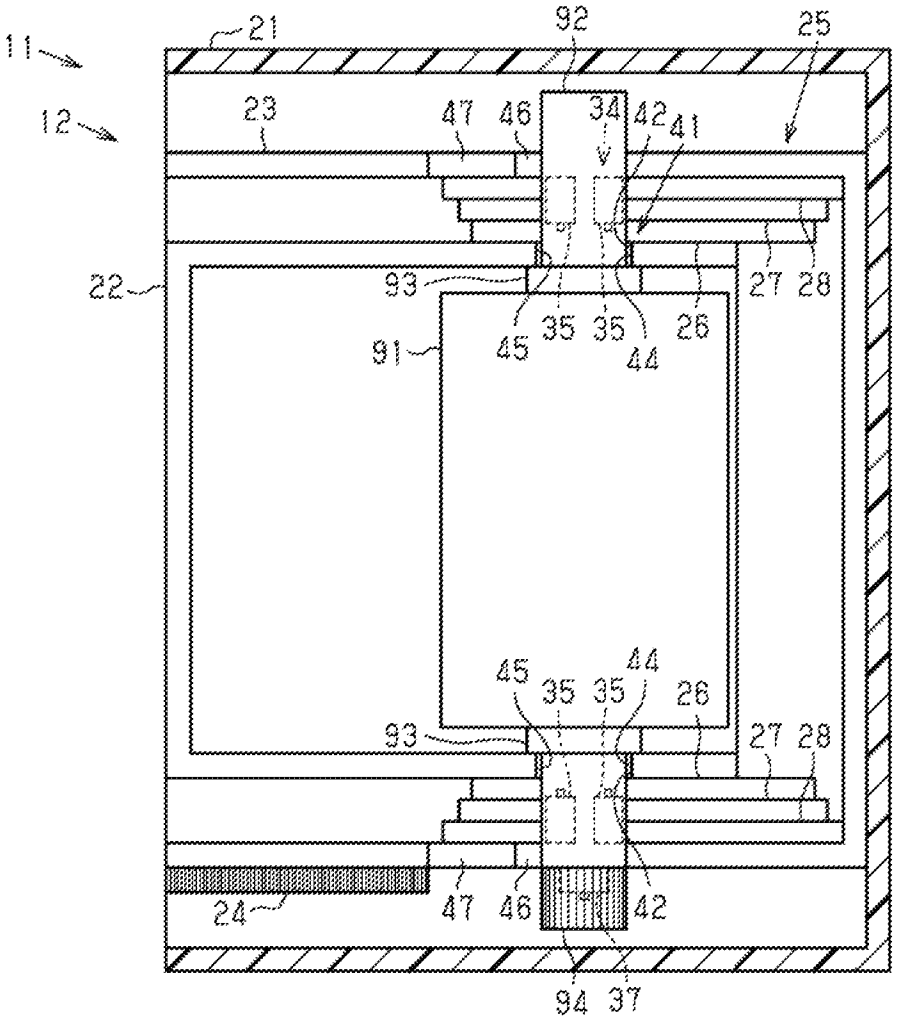
FIG. 2 is a cross-sectional view of FIG. 1.

As illustrated in FIG. 1 and FIG. 2, the main body portion 23 in the present exemplary embodiment includes the first support portions 34 that are configured to support the shaft member 92. The first support portions 34 support the shaft member 92 in the state in which the accommodation portion 22 is mounted to the main body portion 23. The first support portions 34 support the shaft member 92 in a rotatable manner. The first support portions 34 are, for example, bearings.

the first support portion 34 in the present exemplary embodiment includes a plurality of rolling members 35. The plurality of rolling members 35 are held in contact with the peripheral surface of the shaft member 92 so as to support the shaft member 92. The plurality of rolling members 35 are provided so as to support both the ends of the shaft member 92 in the shaft direction. In the present exemplary embodiment, the plurality of rolling members 35 are four rolling members 35. Two rolling members 35 support each of the one end and the other end of the shaft member 92. When the shaft member 92 rotates, the rolling members 35 also rotate.

The transport device 12 may include a torque application mechanism 36 that applies a rotational torque to the shaft member 92 supported by the first support portions 34. For example, the torque application mechanism 36 includes a drive gear 37 and a motor 38. The drive gear 37 is positioned so as to be engaged with the gear 94 in a state in which the shaft member 92 is supported by the first support portions 34.

The motor 38 is coupled with the drive gear 37. When the motor 38 is driven, the drive gear 37 rotates. When the drive gear 37 rotates, a rotational torque is applied to the shaft member 92 via the gear 94. When the torque application mechanism 36 applies a rotational torque to the shaft member 92, tension to be applied to the medium 99 unwound from the roll body 91 can be adjusted.

When the medium 99 is transported, the roller pair 31 rotates. When the roller pair 31 rotates, the medium 99 is unwound from the roll body 91. At this time, the medium 99 is pulled from the roll body 91 with the roller pair 31, and tension is applied to the medium 99. When tension having a predetermined magnitude is applied to the medium 99, the medium 99 can be accurately transported.

When tension applied to the medium 99 is small, there may be a case in which the medium 99 is loosened between the roll body 91 and the roller pair 31. When the medium 99 is loosened, there may be a risk in that the medium 99 is transported in an obliquely tilted state. Thus, when tension applied to the medium 99 is small, wrinkling formed on the medium 99 cannot be eliminated sufficiently, which may degrade transportation accuracy of the medium 99.

When tension applied to the medium 99 is large, there may be a risk in that the medium 99 slips with respect to the roller pair 31. Thus, when tension applied to the medium 99 is large, there may be a risk in that transportation accuracy of the medium 99 is degraded. Further, when tension applied to the medium 99 is large, there may be a risk in that damage of the medium 99 is caused.

For example, when the torque application mechanism 36 applies, to the roll body 91, a rotational torque for causing the roll body 91 to rotate in the direction of unwinding the medium 99, tension applied to the medium 99 is reduced. When the torque application mechanism 36 applies, to the roll body 91, a rotational torque for causing the roll body 91 to rotate in the direction of winding the medium 99, tension applied to the medium 99 is increased. As described above, tension applied to the medium 99 can be adjusted with the torque application mechanism 36.

The accommodation portion 22 includes second support portions 41 that are capable of supporting the shaft member 92. The second support portions 41 support the shaft member 92 in the state in which the accommodation portion 22 is pulled out of the main body portion 23. The second support portions 41 support the shaft member 92 in a rotatable manner.

The second support portions 41 in the present exemplary embodiment are formed of a plurality of grooves 42. The plurality of grooves 42 are held in contact with the peripheral surface of the shaft member 92 so as to support the shaft member 92. The plurality of grooves 42 are provided so as to support both the ends of the shaft member 92. In the present exemplary embodiment, the plurality of grooves 42 are two grooves 42. The plurality of grooves 42 support each of the one and the other end of the shaft member 92.

The plurality of grooves 42 include bottom surfaces 43, first side surfaces 44, and second side surfaces 45. The bottom surface 43 is a surface that receives a load of the shaft member 92. The first side surface 44 and the second side surface 45 are surfaces that are continuous to the bottom surface 43 and extend upward from the bottom surface 43.

The shaft member 92 is supported by the plurality of grooves 42 so that the ends of the shaft member 92 are surrounded by the bottom surfaces 43, the first side surfaces 44, and the second side surfaces 45. With this, the roll body 91 is accommodated in the accommodation portion 22 in a state in which the shaft member 92 is vertically movable along the first side surfaces 44 and the second side surfaces 45 in the plurality of grooves 42.

The shaft member 92 is displaced from a position supported by the first support portions 34 to a position supported by the second support portions 41 in a process during which the accommodation portion 22 is pulled out of the main body portion 23. Specifically, in a process during which the shaft member 92 is displaced from the positions supported by the first support portions 34 to the positions supported by the second support portions 41, the gear 94 is engaged with the rack 24. At least in a state in which the accommodation portion 22 is mounted to the main body portion 23, the second support portions 41 in the present exemplary embodiment support the shaft member 92 at the positions lower than the positions at which the first support portions 34 support the shaft member 92.

The shaft member 92 is displaced from the positions supported by the second support portions 41 to the positions supported by the first support portions 34 in a process during which the accommodation portion 22 is mounted to the main body portion 23. Specifically, in a process during which the shaft member 92 is displaced from the positions supported by the second support portions 41 to the positions supported by the first support portions 34, the gear 94 is engaged with the rack 24. In the present exemplary embodiment, the height at which the second support portions 41 support the shaft member 92 and the height of the shaft member 92 when the rack 24 is engaged with the gear 94 are flush with each other. With this, in the process during which the accommodation portion 22 moves relative to the main body portion 23, the rack 24 and the gear 94 are engaged with each other easily.

The main body portion 23 in the present exemplary embodiment includes a guide surface 46 that guides the shaft member 92 to move between the positions supported by the first support portions 34 and the positions supported by the second support portions 41. The guide surface 46 guides the shaft member 92 from the positions supported by the first support portions 34 to the positions supported by the second support portions 41. The guide surface 46 guides the shaft member 92 from the positions supported by the second support portions 41 to the positions supported by the first support portions 34. The guide surface 46 is, for example, a horizontal surface. The guide surface 46 in the present exemplary embodiment guides the shaft member 92 at the position lower than the positions at which the first support portions 34 support the shaft member 92.

The main body portion 23 in the present exemplary embodiment includes inclined surfaces 47 that guide the shaft member 92 to move between the positions supported by the first support portions 34 and the positions supported by the second support portions 41. The inclined surfaces 47 guide the shaft member 92 from the positions supported by the first support portions 34 to the positions supported by the second support portions 41. The inclined surfaces 47 guide the shaft member 92 from the positions supported by the second support portions 41 to the positions supported by the first support portions 34. The inclined surfaces 47 are surfaces that are continuous from the guide surface 46 to the rack 24. The inclined surfaces 47 are surfaces that are inclined with respect to the guide surface 46. The inclined surfaces 47 in the present exemplary embodiment are surfaces that are inclined downward from the guide surface 46 to the rack 24.

Next, movement of the shaft member 92 in the process during which the accommodation portion 22 is pulled out of the main body portion 23 will be described.

When the accommodation portion 22 is pulled out of the main body portion 23, first, the accommodation portion 22 moves relative to the main body portion 23, and then the first side surfaces 44 press the shaft member 92 supported by the first support portions 34. When being pressed by the first side surfaces 44, the shaft member 92 is displaced from the positions supported by the first support portions 34 to the positions on the guide surface 46. In the present exemplary embodiment, the shaft member 92 is pressed by the first side surfaces 44, and then falls off from the first support portions 34. When falling off from the first support portions 34, the shaft member 92 is placed on the guide surface 46.

Subsequently, when the accommodation portion 22 is further pulled out of the main body portion 23, the shaft member 92 is pressed by the first side surfaces 44, and then is displaced along the guide surface 46. The shaft member 92 is displaced along the guide surface 46 toward the inclined surfaces 47. In this manner, the guide surface 46 guides movement of the shaft member 92.

Figure 3:
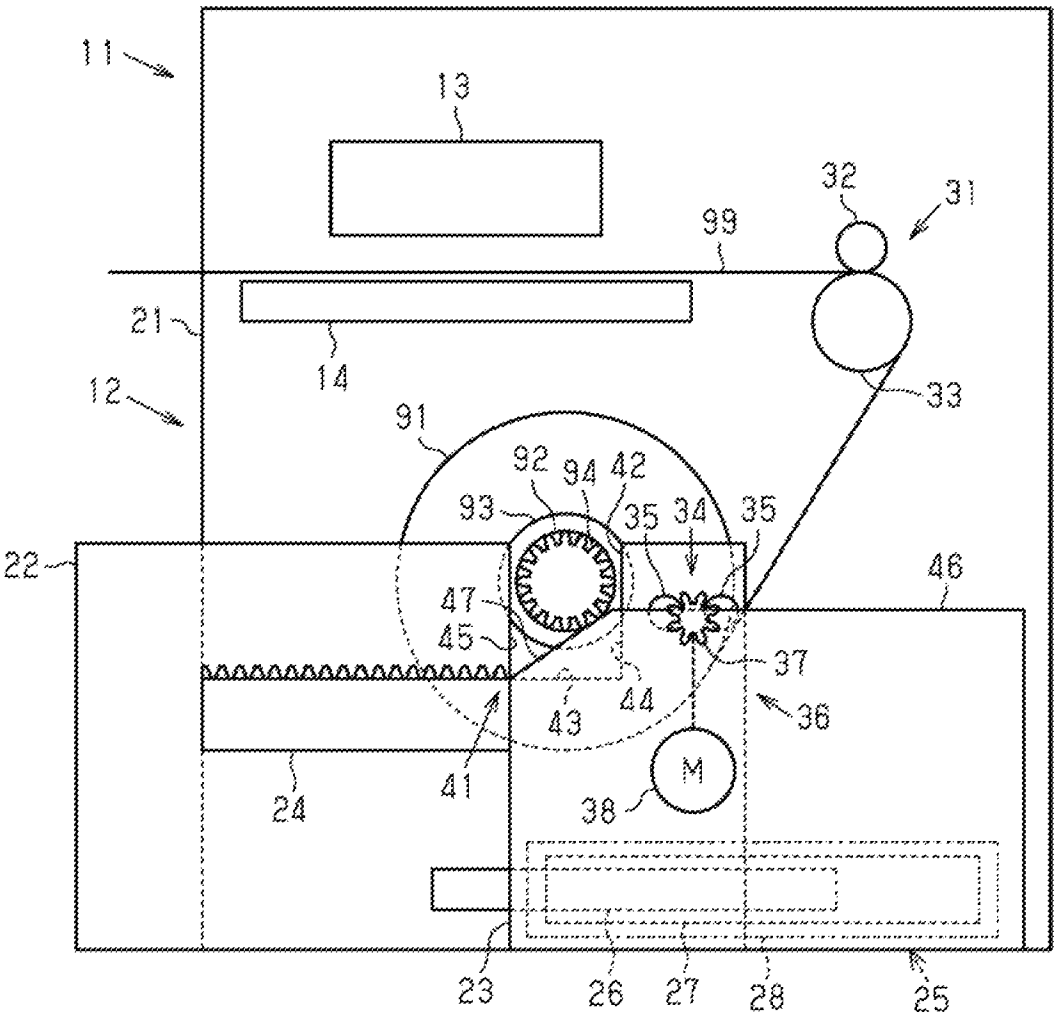
FIG. 3 is a side view illustrating a state in which an accommodation portion is pulled out of a main body portion.
Figure 4:
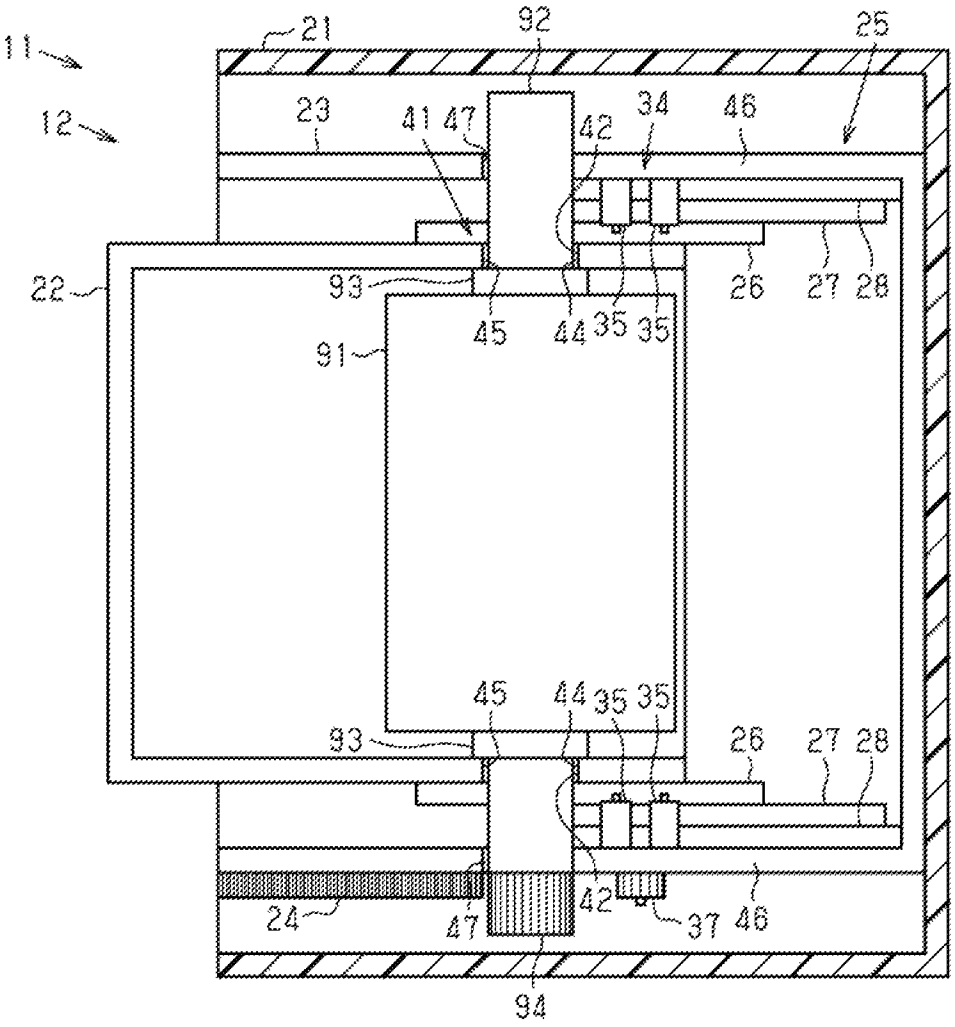
FIG. 4 is a cross-sectional view of FIG. 3.

As illustrated in FIG. 3 and FIG. 4, when the accommodation portion 22 is further pulled out of the main body portion 23, the shaft member 92 is pressed by the first side surfaces 44, and then is displaced from the positions on the guide surface 46 to the positions on the inclined surfaces 47. Due to a gravitational action, the shaft member 92 is displaced along the inclined surfaces 47 toward the rack 24. In this manner, the inclined surfaces 47 guide movement of the shaft member 92.

Figure 5:
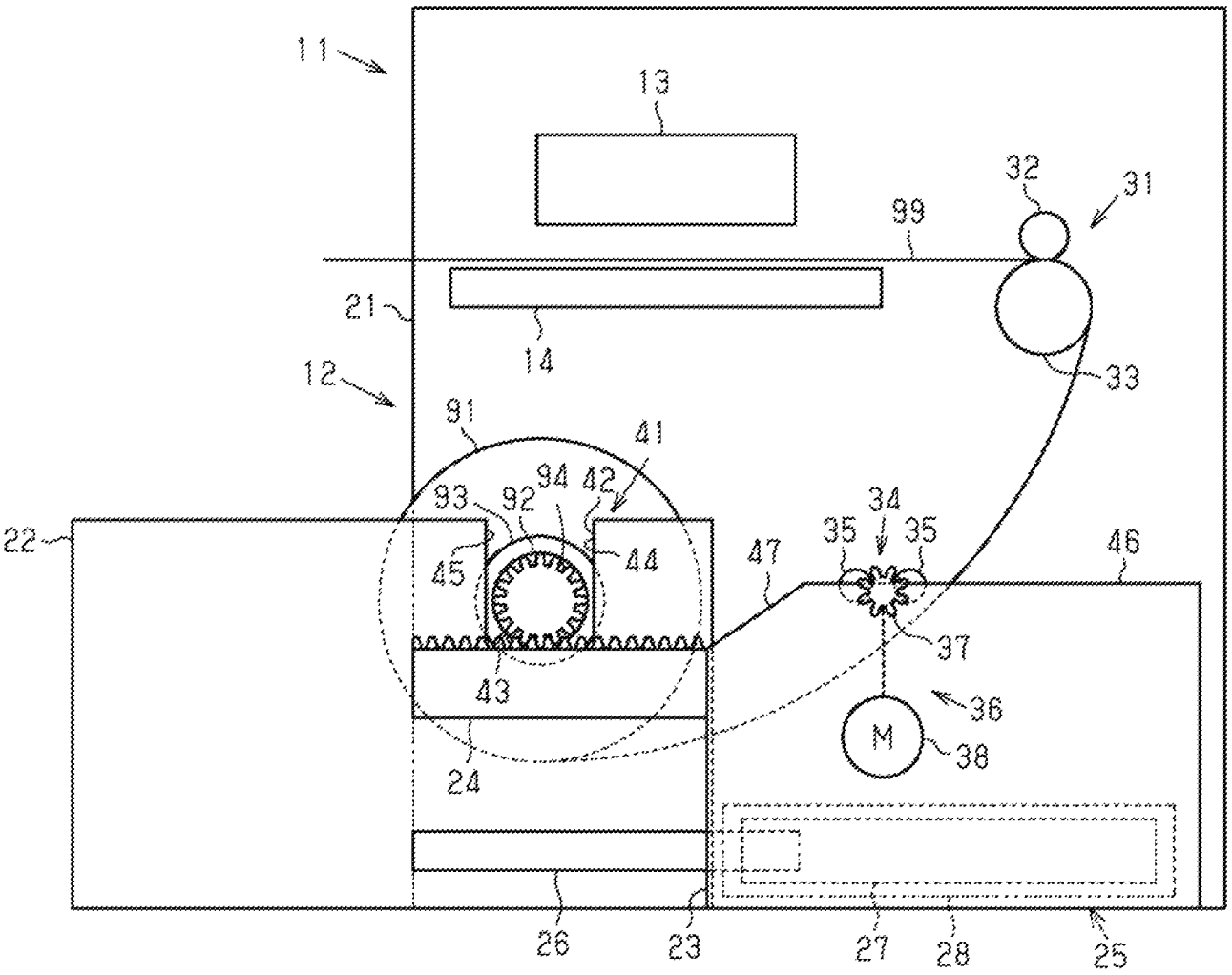
FIG. 5 is a side view illustrating a state in which a rack and a gear are engaged with each other.
Figure 6:
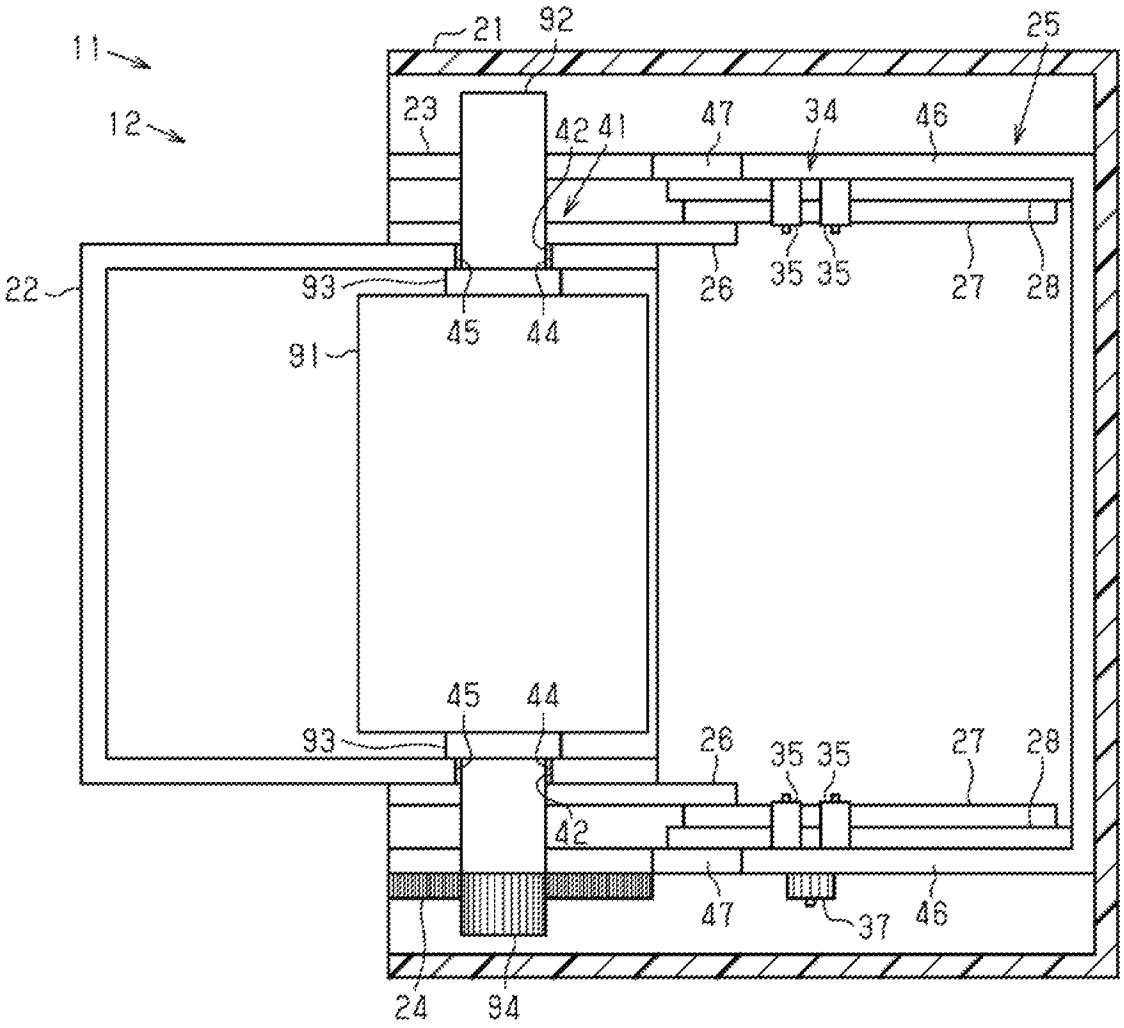
FIG. 6 is a cross-sectional view of FIG. 5.

As illustrated in FIG. 5 and FIG. 6, when the accommodation portion 22 is further pulled out of the main body portion 23, the shaft member 92 is guided by the inclined surfaces 47, and then is displaced from the positions on the inclined surfaces 47 to the position at which the gear 94 is engaged with the rack 24. At this time, the rack 24 receives a load of the shaft member 92. When the accommodation portion 22 is pulled out of the main body portion 23 in a state in which the rack 24 is engaged with the gear 94, the shaft member 92 is pressed by the first side surfaces 44, and rotates while the rack 24 and the gear 94 are engaged with each other. At this time, the medium 99 is unwound from the roll body 91.

The medium 99 unwound from the roll body 91 is nipped between the roller pair 31. With this, when the accommodation portion 22 is pulled out of the main body portion 23, the roll body 91 is pulled out together with the accommodation portion 22 from the main body portion 23. As a result, large tension is applied to the medium 99. Specifically, when the accommodation portion 22 is pulled out of the main body portion 23, the medium 99 nipped between the roller pair 31 is pulled by the roll body 91. As a result, large tension is applied to the medium 99. When the medium 99 is pulled by the roll body 91 and large tension is applied thereto, there may be a risk in that the medium 99 is damaged. Further, when large tension is applied to the medium 99, there may be a risk in that the medium 99 slips with respect to the roller pair 31.

Specifically, when the rack 24 is not provided, the following problems are caused. When the accommodation portion 22 is pulled out of the main body portion 23, the shaft member 92 is pressed by the first side surfaces 44 in the drawing direction, the shaft member 92 slides on the bottom surfaces 43. At this time, when the shaft member 92 slides on the bottom surfaces 43, sliding resistance (frictional force) is generated between the shaft member 92 and the bottom surfaces 43. Due to the sliding resistance and the external force generated at the time of drawing the accommodation portion 22 out from the main body portion 23, large tension is disadvantageously applied to the medium 99 between the roll body 91 and the roller pair 31.

With respect to this, in the transport device 12 according to the present exemplary embodiment, when the accommodation portion 22 is pulled out of the main body portion 23, the rack 24 and the gear 94 are engaged with each other. With this, the roll body 91 rotates so as to unwind the medium 99. Thus, when the accommodation portion 22 is pulled out of the main body portion 23, a risk of pulling the medium 99 with the roll body 91 can be lowered. With this, a risk of applying large tension to the medium 99 can be lowered.

Figure 7:
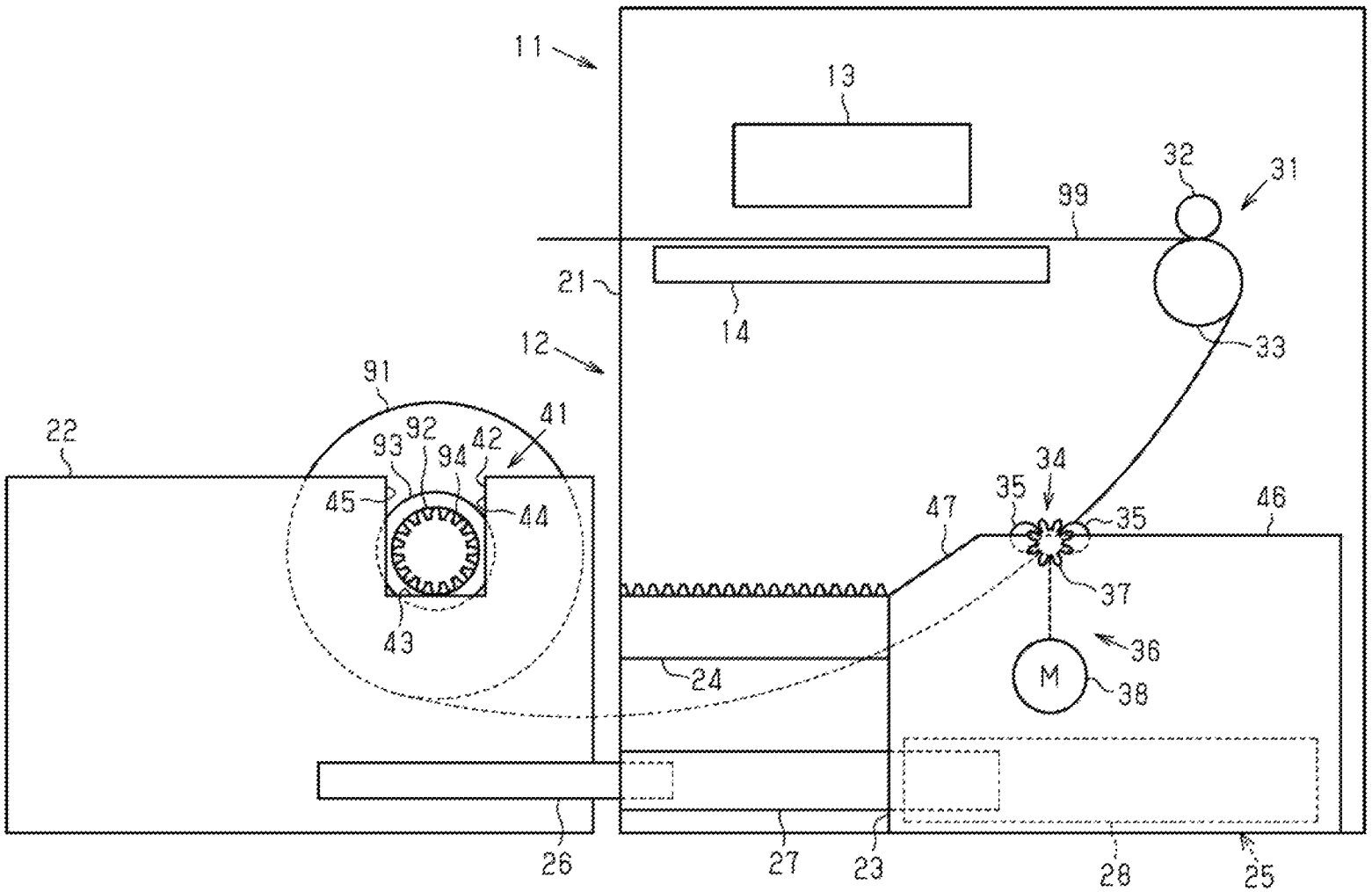
FIG. 7 is a side view illustrating a state in which the accommodation portion is pulled out of the main body portion.
Figure 8:
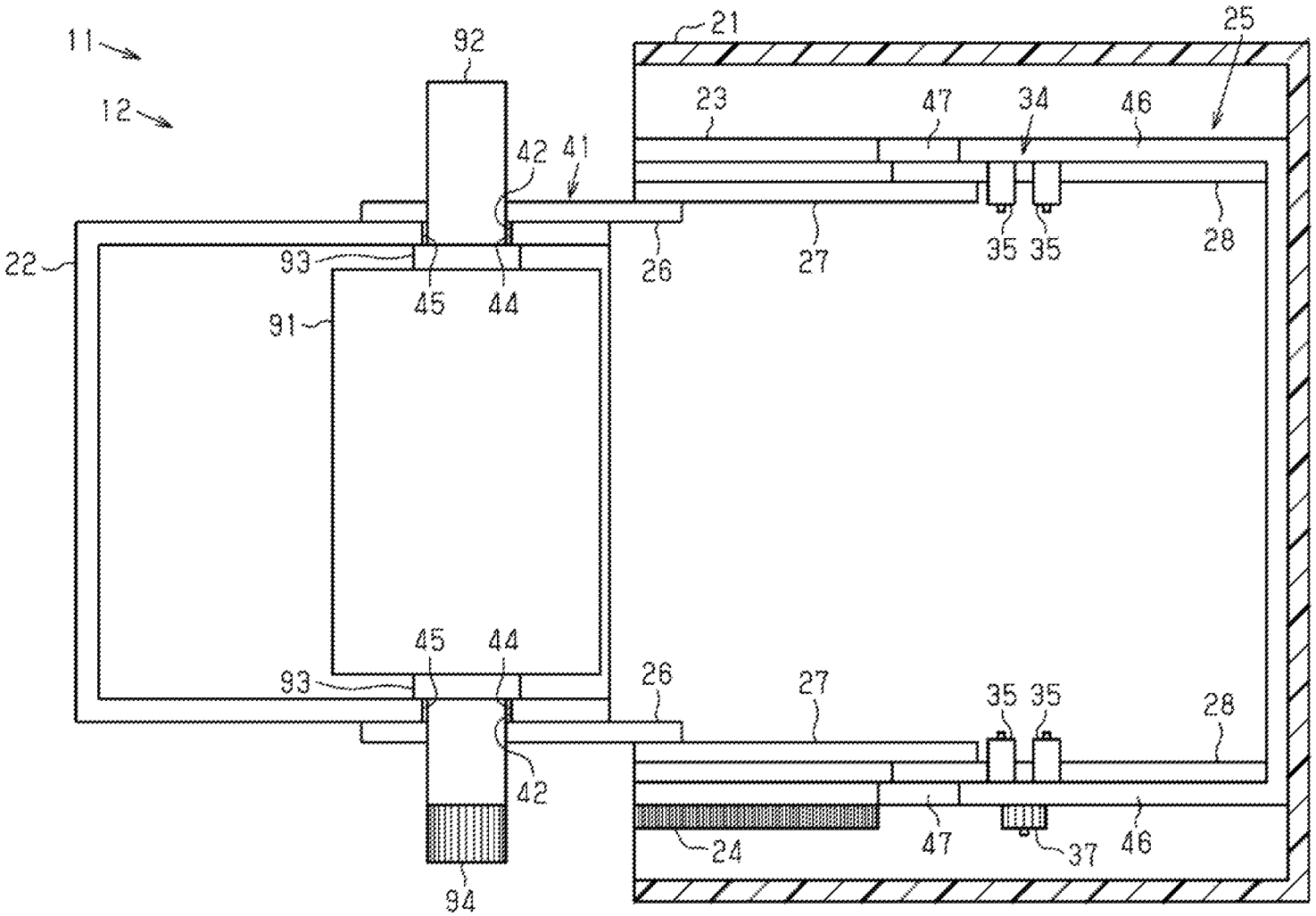
FIG. 8 is a cross-sectional view of FIG. 7.

As illustrated in FIG. 7 and FIG. 8, when the entire accommodation portion 22 is pulled out of the main body portion 23, meshing between the rack 24 and the gear 94 is canceled. With this, the shaft member 92 is supported by the second support portions 41. At this time, the shaft member 92 can be removed from the accommodation portion 22. As described above, when the accommodation portion 22 is pulled out of the main body portion 23, the shaft member 92 is displaced in the grooves 42 with respect to the accommodation portion 22, and is displaced along the rack 24, the guide surface 46, and the inclined surfaces 47 with respect to the main body portion 23.

When the accommodation portion 22 is mounted to the main body portion 23, the shaft member 92 is pressed by the second side surfaces 45, and then is displaced along the rack 24, the guide surface 46, and the inclined surfaces 47. When the accommodation portion 22 is mounted to the main body portion 23, the shaft member 92 is held in contact with the rack 24, the inclined surfaces 47, and the guide surface 46 in the stated order.

When the accommodation portion 22 is mounted to the main body portion 23, the gear 94 is engaged with the rack 24. With this, the roll body 91 rotates so as to wind the medium 99. With this, the medium 99 that is loosened at the time of drawing the accommodation portion 22 from the main body portion 23 is wound by the roll body 91.

When the accommodation portion 22 is mounted to the main body portion 23 while the medium 99 unwound from the roll body 91 is loosened, the loosened medium 99 is nipped between the accommodation portion 22 and the main body portion 23. Thus, there may be a risk in that the medium 99 is damaged. Thus, when the accommodation portion 22 is mounted to the main body portion 23, the loosened medium 99 is wound around the roll body 91. With this, a risk of damaging the medium 99 can be lowered.

Next, the functions and effects of the exemplary embodiment will be described.

(1) The rack 24 is engaged with the gear 94 when the accommodation portion 22 is pulled out of the main body portion 23 by moving relative to the main body portion 23.

When the accommodation portion 22 is pulled out of the main body portion 23 in the state in which the rack 24 is engaged with the gear 94, the roll body 91 mounted to the shaft member 92 rotates. When the roll body 91 rotates, the medium 99 is unwound. Thus, when the accommodation portion 22 is pulled out of the main body portion 23, the medium 99 nipped between the roller pair 31 is pulled by the roll body 91. With this, a risk of applying large tension to the medium 99 is suppressed. With this, a risk of damaging the medium 99 can be lowered.

(2) The second support portions 41 support the shaft member 92 in the state in which the accommodation portion 22 is pulled out of the main body portion 23, and support the shaft member 92 at the positions lower than the positions at which the first support portions 34 support the shaft member 92. In this manner, in the state in which the accommodation portion 22 is mounted to the main body portion 23, a risk of supporting the shaft member 92 with both the first support portions 34 and the second support portions 41 may be lowered. With this, as compared to a case where the shaft member 92 is supported by both the first support portions 34 and the second support portions 41, friction resistance caused at the time of rotation of the shaft member 92 can be lowered. Particularly, when the medium 99 is pulled out of the roll body 91, the shaft member 92 rotates while sliding on the bottom surfaces 43. With this, increase of sliding resistance can be suppressed. With this, increase of a load of the roller pair 31 is suppressed.

(3) The main body portion 23 includes the inclined surfaces 47 that guide the shaft member 92 to move between the positions supported by the first support portions 34 and the positions supported by the second support portions 41. With this, the shaft member 92 can be caused to move smoothly between the first support portions 34 and the second support portions 41 that support the shaft member 92 at different heights.

(4) The transport device 12 includes the guide rail 25 that couples the accommodation portion 22 and the main body portion 23 with each other and guides the accommodation portion 22 and the main body portion 23 to move relatively. With this, the accommodation portion 22 can be smoothly pulled out of the main body portion 23.

The present embodiment described above may be modified as follows. The present embodiment and modified examples thereof to be described below may be implemented in combination within a range in which a technical contradiction does not arise.

- The second support portions 41 may support the shaft member 92 at the same height as the positions at which the first support portions 34 support the shaft member 92. In this case, in the state in which the accommodation portion 22 is mounted to the main body portion 23, the shaft member 92 are supported by both the first support portions 34 and the second support portions 41. In this modified example, for example, the first support portions 34, the rack 24, the guide surface 46, and the second support portions 41 support the shaft member 92 at the positions at the same height.
- The second support portions 41 may support the shaft member 92 at the positions higher than the positions at which the first support portions 34 support the shaft member 92.

Figure 9:
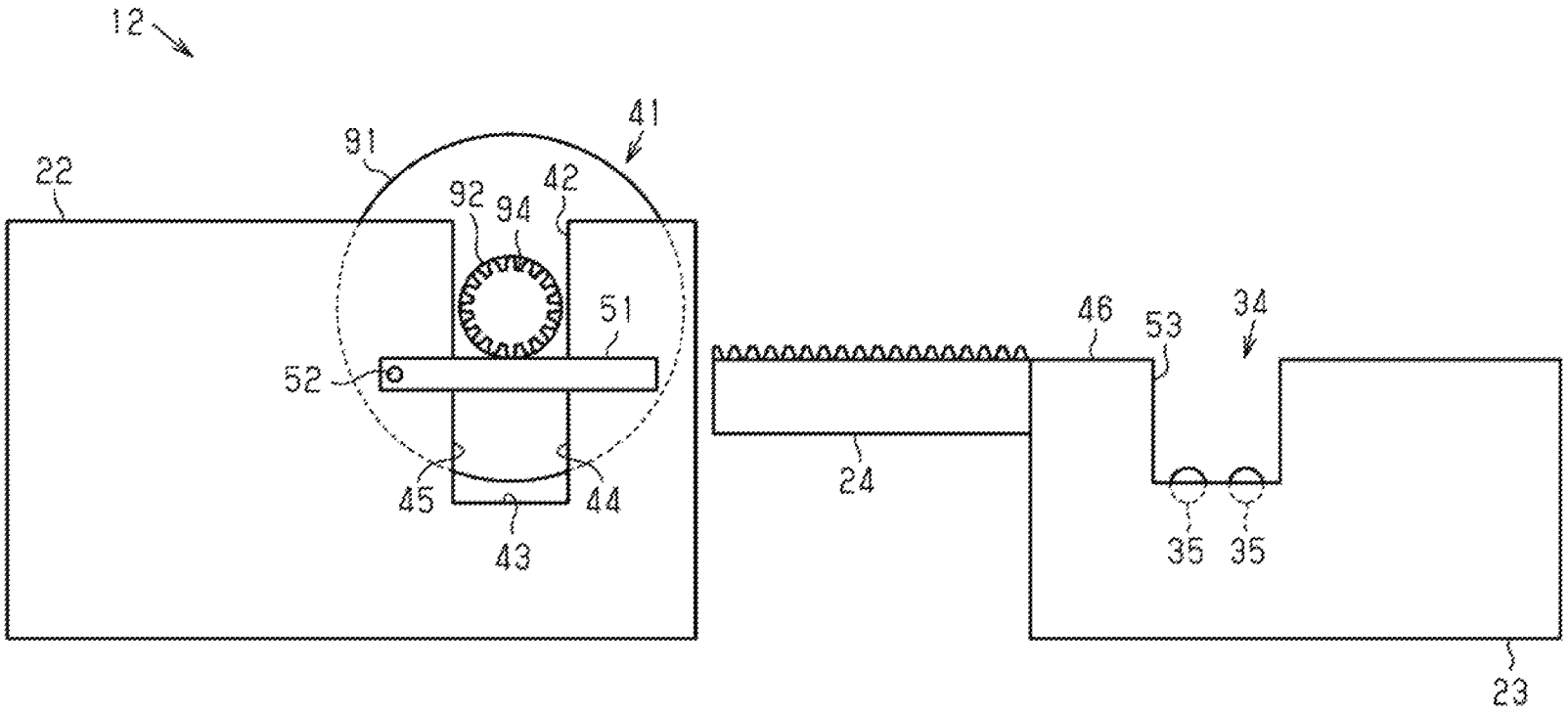
FIG. 9 is a side view schematically illustrating a first modified example of the transport device.

As illustrated in FIG. 9, in a first modified example, the second support portions 41 include a support member 51 that supports the shaft member 92 in the grooves 42. The support member 51 is configured to be rotatable about a shaft 52. The shaft 52 is provided to one end of the support member 51. In FIG. 9, the support member 51 is positioned so as to cross the grooves 42. The support member 51 supports the shaft member 92 at the position higher than the bottom surfaces 43 of the grooves 42.

The main body portion 23 has recessed grooves 53 that are recessed downward from the guide surface 46. The first support portions 34 are positioned at bottom parts of the recessed grooves 53. Thus, the first support portions 34 in the first modified example support the shaft member 92 at the positions lower than the guide surface 46.

Figure 10:
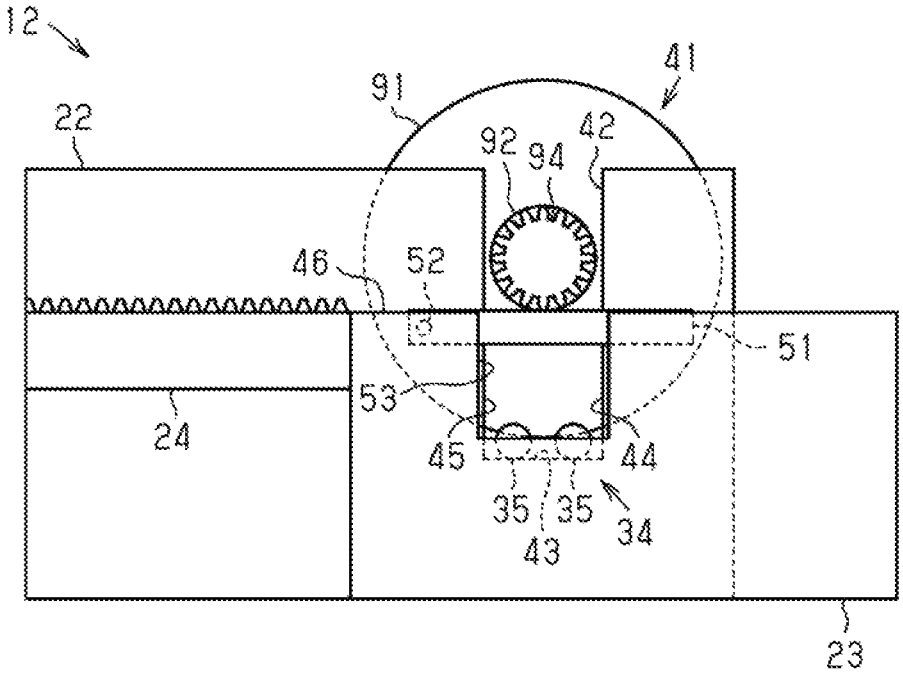
FIG. 10 is a side view illustrating a state in which the accommodation portion is mounted to the main body portion in the first modified example.

As illustrated in FIG. 10, when the accommodation portion 22 is mounted to the main body portion 23, the shaft member 92 supported by the support member 51 is positioned on the recessed grooves 53. The bottom surfaces 43 of the grooves 42 are positioned at the positions lower than the bottom parts of the recessed grooves 53.

Figure 11:
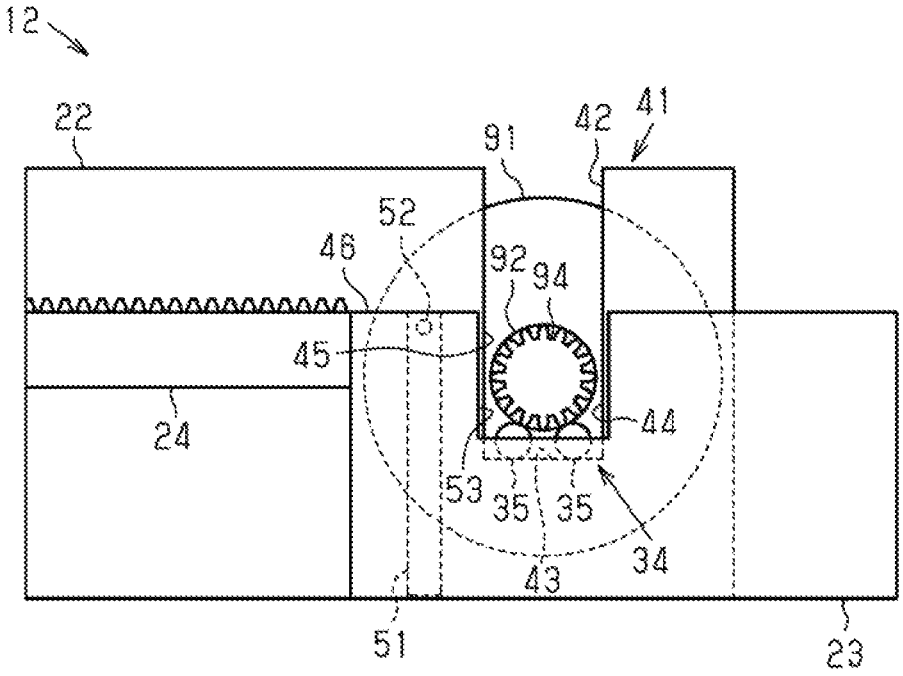
FIG. 11 is a side view illustrating a state in which first support portions support a shaft member in the first modified example.

As illustrated in FIG. 11, when the support member 51 rotates in the state in which the accommodation portion 22 is mounted to the main body portion 23, the shaft member 92 falls in the grooves 42. At this time, the support member 51 rotates so that the other end opposite to the one end to which the shaft 52 is mounted is oriented downward. Specifically, the support member 51 is displaced from the position crossing the grooves 42 to the position not crossing the grooves 42. With this, the shaft member 92 is supported by the first support portions 34. As described above, in the first modified example, the first support portions 34 support the shaft member 92 at the positions lower than the positions at which the second support portions 41 support the shaft member 92. When the accommodation portion 22 is pulled out of the main body portion 23, it is only required to displace the support member 51 at the position crossing the grooves 42.

Next, a second modified example different from the first modified example will be given.

Figure 12:
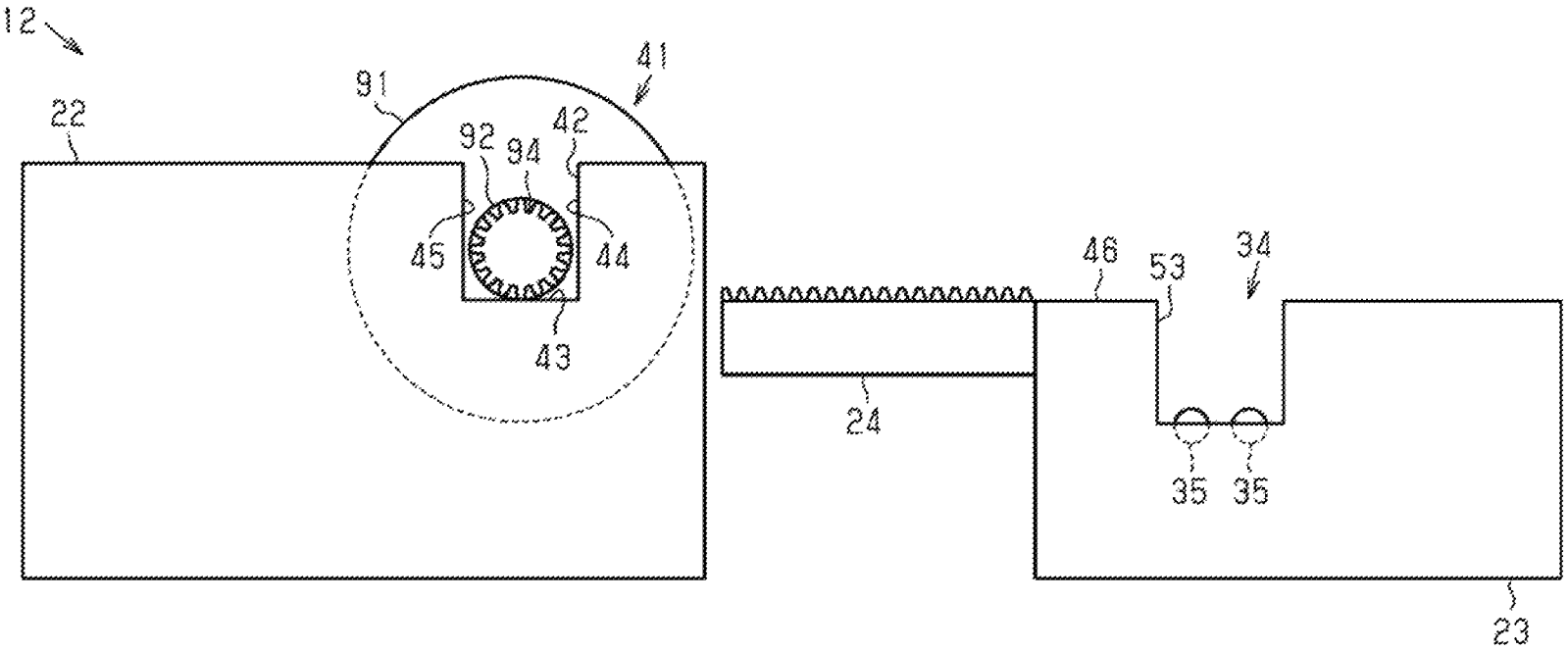
FIG. 12 is a side view schematically illustrating a second modified example of the transport device.

In FIG. 12, in the second modified example, the main body portion 23 has the recessed grooves 53 that are recessed downward from the guide surface 46. The first support portions 34 are positioned at bottom parts of the recessed grooves 53. Thus, similarly to the first modified example, the first support portions 34 in the second modified example support the shaft member 92 at the positions lower than the guide surface 46.

Figure 13:
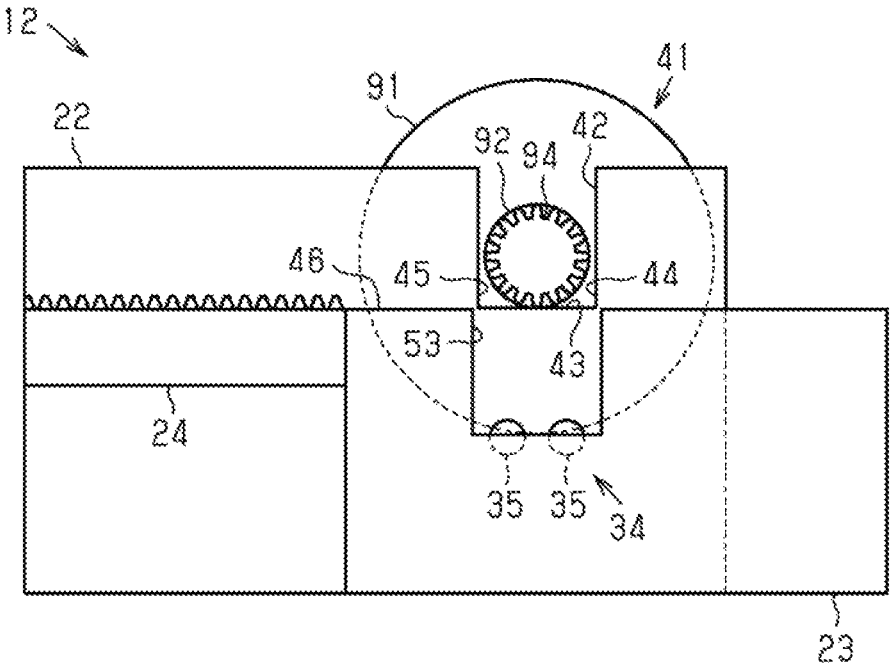
FIG. 13 is a side view illustrating a state in the middle of mounting the accommodation portion to the main body portion in the second modified example.

As illustrated in FIG. 13, when the accommodation portion 22 is pressed into the main body portion 23 so that the accommodation portion 22 is mounted to the main body portion 23, the shaft member 92 supported by the bottom surfaces 43 of the grooves 42 is placed on the recessed grooves 53. At this time, the bottom surfaces 43 of the grooves 42 are positioned at the positions higher than the bottom parts of the recessed grooves 53.

Figure 14:
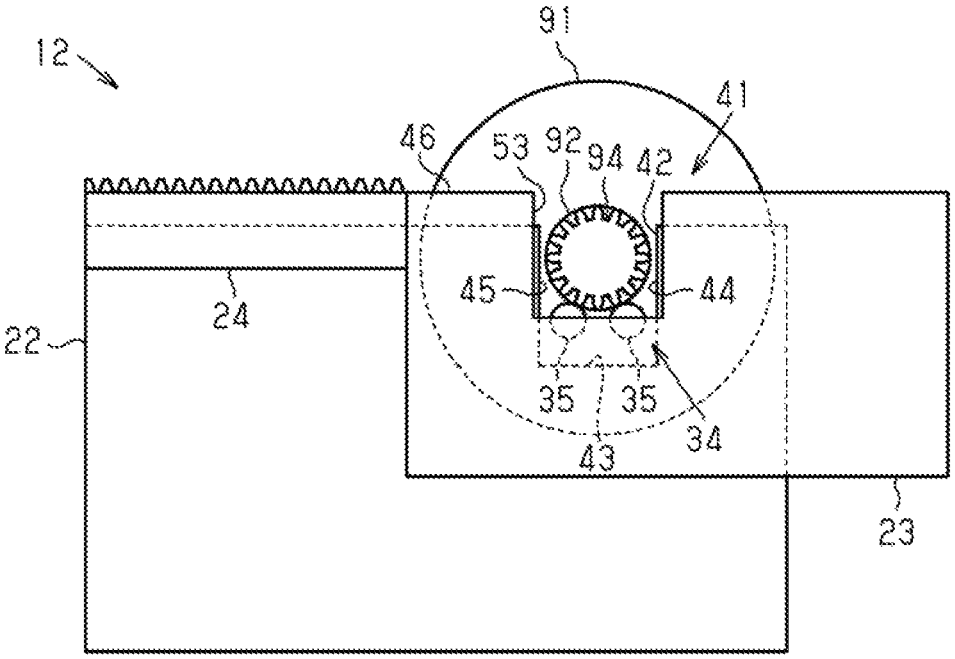
FIG. 14 is a side view illustrating a state in which the accommodation portion is mounted to the main body portion in the second modified example.

As illustrated in FIG. 14, when the accommodation portion 22 is caused to move downward with respect to the main body portion 23 so that the accommodation portion 22 is mounted to the main body portion 23, the positions of the bottom surfaces 43 are lower than the positions of the bottom parts of the recessed grooves 53. At this time, the shaft member 92 is displaced from the positions supported by the second support portions 41 to the positions supported by the first support portions 34. With this, the accommodation portion 22 is mounted to the main body portion 23. As described above, in the second modified example, the first support portions 34 support the shaft member 92 at the positions lower than the positions at which the second support portions 41 support the shaft member 92.

Gears 94 may be provided to both the ends of the shaft member 92. In this case, two racks 24 are provided so as to correspond to the two gears 94.

The shaft member 92 is not limited to a configuration of being inserted into the roll body 91, and may be configured to support the roll body 91 by being mounted to both the ends of the roll body 91.

The medium 99 is not limited to paper, and may be fibers or a plastic film.

The recording device 11 is not limited to an ink jet-type, and may be configured to record an image electrophotographically, for example.

The recording unit 13 may be a thermal head that performs recording by applying heat to the medium 99.

The liquid ejected by the recording unit 13 is not limited to ink, and may be, for example, a liquid material including particles of a functional material dispersed or mixed in liquid. For example, the recording unit 13 may eject a liquid material including a material such as an electrode material or a pixel material used in manufacture of a liquid crystal display, an electroluminescent display, and a surface emitting display in a dispersed or dissolved form.

Hereinafter, technical concepts and effects thereof that are understood from the above-described embodiments and modified examples will be described.

A transport device unwinds a medium from a roll body to which a shaft member is mounted and transports the medium. The transport device includes an accommodation portion configured to accommodate the roll body, a main body portion to which the accommodation portion is mounted, and a roller pair configured to nip the medium. The accommodation portion and the main body portion are relatively movable. The main body portion includes a rack configured to engage with a gear of the shaft member. The rack is engaged with the gear when the accommodation portion moves relative to the main body portion to be pulled out of the main body portion.

According to this configuration, when the accommodation portion is pulled out of the main body portion in the state in which the rack is engaged with the gear, the roll body mounted to the shaft member rotates. When the roll body rotates, the medium is unwound. Thus, when the accommodation portion is pulled out of the main body portion, the medium nipped between the roller pair is pulled by the roll body. With this, a risk of applying large tension to the medium is suppressed. With this, a risk of damaging the medium can be lowered.

In the transport device, the main body portion includes a first support portion capable of supporting the shaft member. The accommodation portion includes a second support portion capable of supporting the shaft member. The first support portion supports the shaft member in a state in which the accommodation portion is mounted to the main body portion. The second support portion supports the shaft member in a state in which the accommodation portion is pulled out of the main body portion, and supports the shaft member at a position lower than a position at which the first support portion supports the shaft member.

According to this configuration, in the state in which the accommodation portion is mounted to the main body portion, a risk of supporting the shaft member with both the first support portion and the second support portion may be lowered. With this, as compared to a case where the shaft member is supported by both the first support portion and the second support portion, friction resistance caused at the time of rotation of the shaft member can be lowered.

In the transport device, the main body portion may include an inclined surface that guides the shaft member to move between the position supported by the first support portion and the position supported by the second support portion.

According to this configuration, the shaft member can be caused to move smoothly between the first support portion and the second support portion that support the shaft member at different heights.

The transport device may include a guide rail that couples the accommodation portion and the main body portion with each other and guides the accommodation portion and the main body portion to move relatively.

According to this configuration, the accommodation portion can be smoothly pulled out of the main body portion.

A recording device includes the transport device and a recording unit configured to perform recording onto the medium.

According to this configuration, the same effect as the transport device described above can be obtained.

What is claimed is:

1. A transport device configured to transport a medium by unwinding the medium from a roll body to which a shaft member is mounted, the transport device comprising:

an accommodation portion configured to accommodate the roll body;

a main body portion to which the accommodation portion is mounted; and a roller pair configured to nip the medium, wherein the accommodation portion and the main body portion are relatively movable, the main body portion includes a rack configured to engage with a gear of the shaft member;

the rack is engaged with the gear when the accommodation portion moves relative to the main body portion to be pulled out of the main body portion, the main body portion includes a first support portion configured to support the shaft member, the accommodation portion includes a second support portion configured to support the shaft member, the first support portion supports the shaft member in a state in which the accommodation portion is mounted to the main body portion, and the second support portion supports the shaft member in a state in which the accommodation portion is pulled out of the main body portion and supports the shaft member at a position lower than a position at which the first support portion supports the shaft member.

2. The transport device according to claim 1, wherein the main body portion includes an inclined surface configured to guide the shaft member to move between a position supported by the first support portion and a position supported by the second support portion.

3. The transport device according to claim 1, comprising a guide rail configured to couple the accommodation portion and the main body portion, and guide the accommodation portion and the main body portion to move relatively.

4. A recording device comprising:

the transport device according to claim 1; and a recording unit configured to perform recording onto the medium.

5. The transport device according to claim 2, wherein the inclined surfaces are surfaces that are inclined downward from the position at which the first support portion supports the shaft member to the position at which the second support portion supports the shaft member.

* * * * *